US007817120B2

(12) United States Patent
Peng et al.

(10) Patent No.: US 7,817,120 B2
(45) Date of Patent: Oct. 19, 2010

(54) SYSTEM FOR DISPLAYING IMAGE AND DRIVING DISPLAY ELEMENT METHOD

(75) Inventors: Du-Zen Peng, Jhubei (TW); Ping-Lin Liu, Tainan (TW)

(73) Assignee: TPO Displays Corp., Chu-Nan (TW)

( * ) Notice: Subject to any disclaimer, the term of this patent is extended or adjusted under 35 U.S.C. 154(b) by 833 days.

(21) Appl. No.: 11/801,162

(22) Filed: May 8, 2007

(65) Prior Publication Data

US 2007/0262931 A1 Nov. 15, 2007

(30) Foreign Application Priority Data

May 9, 2006 (TW) ..... 95116371 A

(51) Int. Cl.
*G09G 3/30* (2006.01)

(52) U.S. Cl. ..... 345/76; 315/169.3

(58) Field of Classification Search ..... 345/76–82, 345/204; 315/169.1–169.3
See application file for complete search history.

(56) References Cited

U.S. PATENT DOCUMENTS

| | | | | |
|---|---|---|---|---|
| 6,486,606 | B1 * | 11/2002 | Ting | 315/169.1 |
| 6,924,602 | B2 * | 8/2005 | Komiya | 315/169.3 |
| 6,977,634 | B2 * | 12/2005 | Kim et al. | 345/87 |
| 7,414,599 | B2 * | 8/2008 | Chung et al. | 345/76 |
| 2002/0175884 | A1 * | 11/2002 | Kim et al. | 345/76 |
| 2003/0122745 | A1 * | 7/2003 | Miyazawa | 345/76 |
| 2003/0122756 | A1 * | 7/2003 | Kim et al. | 345/87 |
| 2003/0197472 | A1 | 10/2003 | Kanauchi et al. | |
| 2005/0088378 | A1 | 4/2005 | Ozawa et al. | |
| 2005/0237281 | A1 * | 10/2005 | Tam | 345/76 |
| 2006/0023551 | A1 | 2/2006 | Peng et al. | |

(Continued)

FOREIGN PATENT DOCUMENTS

EP 1536405 6/2005

OTHER PUBLICATIONS

Peng et al.; "P-134: Novel Pixel Compensation Circuit for AMOLED Display"; SID '05 Digest; pp. 814-817.

(Continued)

*Primary Examiner*—Nitin Patel
(74) *Attorney, Agent, or Firm*—Liu & Liu

(57) ABSTRACT

A pixel driving circuit with threshold voltage and power supply voltage compensation. The pixel circuit includes a storage capacitor, a transistor, a transfer circuit, a driving element, and a switching circuit. The transistor has a gate coupled to a discharge signal and is coupled between a first node and a second node. The discharge signal directs the transistor to turn on and then discharges the storage capacitor in a first period. The transfer circuit transfers a data signal or a reference signal to a first node of the storage capacitor. The driving element has a first terminal coupled to a first voltage, a second terminal coupled to a second node of the storage capacitor and a third terminal outputting a driving current. The switching circuit is coupled between the driving element and a display element. The switching circuit can be controlled to diode-connect the driving element in a second period, allowing the driving current to be output to the display element in a third time period.

20 Claims, 7 Drawing Sheets

U.S. PATENT DOCUMENTS

| | | | | |
|---|---|---|---|---|
| 2006/0221013 | A1* | 10/2006 | Kimura | 345/76 |
| 2006/0250330 | A1* | 11/2006 | Fish | 345/76 |
| 2007/0063933 | A1* | 3/2007 | Chung | 345/76 |
| 2008/0042941 | A1* | 2/2008 | Peng et al. | 345/76 |

OTHER PUBLICATIONS

Peng et al., "7-inch WVGA AM-OLED Display with Color Filter on Array (COA) and Pixel Compensation Technology"; OLED4/AMD5-2; IDW/AD '05; pp. 629-632.

* cited by examiner

10

SYSTEM FOR DISPLAYING IMAGE AND DRIVING DISPLAY ELEMENT METHOD

BACKGROUND OF THE INVENTION

1. Field of the Invention

The invention relates to a pixel driving circuit and, in particular, to a pixel driving circuit compensating threshold voltage and power supply.

2. Description of the Related Art

Organic light emitting diode (OLED) displays that use organic compounds as a lighting material to light are flat displays. The advantage of the OLED displays is small size, light weight, wider viewing angle, high contrast ratio and high speed.

Active matrix organic light emitting diode (AMOLED) displays are currently emerging as the next generation of flat panel displays. Compared with active matrix liquid crystal displays (AMLCD), the AMOLED display has many advantages, such as higher contrast ratio, wider viewing angle, thinner module without backlight, low power consumption, and low cost. Unlike the AMLCD display, which is driven by a voltage source, an AMOLED display requires a current source to drive a display device EL (electroluminescent). The brightness of display device EL is proportional to the current conducted thereby. Variations in current level have a great impact on brightness uniformity of an AMOLED display. Thus, the quality of a pixel driving circuit is critical to the quality of an AMOLED display.

FIG. 1 shows a conventional 2T1C (2 transistors and 1 capacitor) pixel driving circuit 10 in an AMOLED display. Pixel driving circuit 10 comprises transistors Mx and My. When signal SCAN turns on transistor Mx, data signal shown as $V_{data}$ in the FIG. 1 is loaded into a gate of p-type transistor My and stored in capacitor Cst. Thus, there will be a constant current driving display device EL to emit light. Typically, in an AMOLED display, a current source is implemented by a P-type TFT (My in FIG. 1) gated by data signal $V_{data}$ and having source and drain connected to $V_{dd}$ and the anode of display device EL, respectively, as shown in FIG. 1. The brightness of display device EL with respect to $V_{data}$ therefore has the following relation.

$$\text{Brightness} \propto \text{current} \propto (V_{dd}-V_{data}-V_{th})^2$$

Where $V_{th}$ is a threshold voltage of transistor My and $V_{dd}$ is a power supply voltage. Since there is typically a variation in $V_{th}$ for a LTPS type TFT due to a low temperature polysilicon (LTPS) process, it is supposed that a non-uniformity problem in brightness exists in an AMOLED display if $V_{th}$ is not properly compensated. Moreover, a voltage drop in the power line also causes the brightness non-uniformity problem. To overcome such problems, implementation of a pixel driving circuit with threshold voltage $V_{th}$ and power supply voltage $V_{dd}$ compensation to improve display uniformity is required.

BRIEF SUMMARY OF THE INVENTION

The invention provides a pixel driving circuit with threshold voltage and power supply voltage compensation. The pixel circuit includes a storage capacitor, a transistor, a transfer circuit, a driving element, and a switching circuit. The transistor has a gate coupled to a discharge signal and is coupled between a first node and a second node. The discharge signal directs the transistor to turn on and then discharges the storage capacitor during a first period. The transfer circuit transfers a data signal or a reference signal to a first node of the storage capacitor. The driving element has a first terminal coupled to a first voltage, a second terminal coupled to a second node of the storage capacitor, and a third terminal outputting a driving current. The switching circuit is coupled between the driving element and a display element. The switching circuit is directed to diode-connect the driving element in a second period, allowing the driving current to be output to the display element in a third time period.

The invention provides a method for driving a display element. The display element comprises a driving element and a storage capacitor. The method comprises: discharging the storage capacitor through a transistor by applying a discharge signal thereto, loading a data signal into a first terminal of the storage capacitor, loading a gate voltage of the driving element into a second terminal of the storage capacitor, loading a reference signal into the first terminal of the storage capacitor, and coupling the loaded data signal, the gate voltage and the reference signal into the driving element to provide a threshold-independent driving current to the display element.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
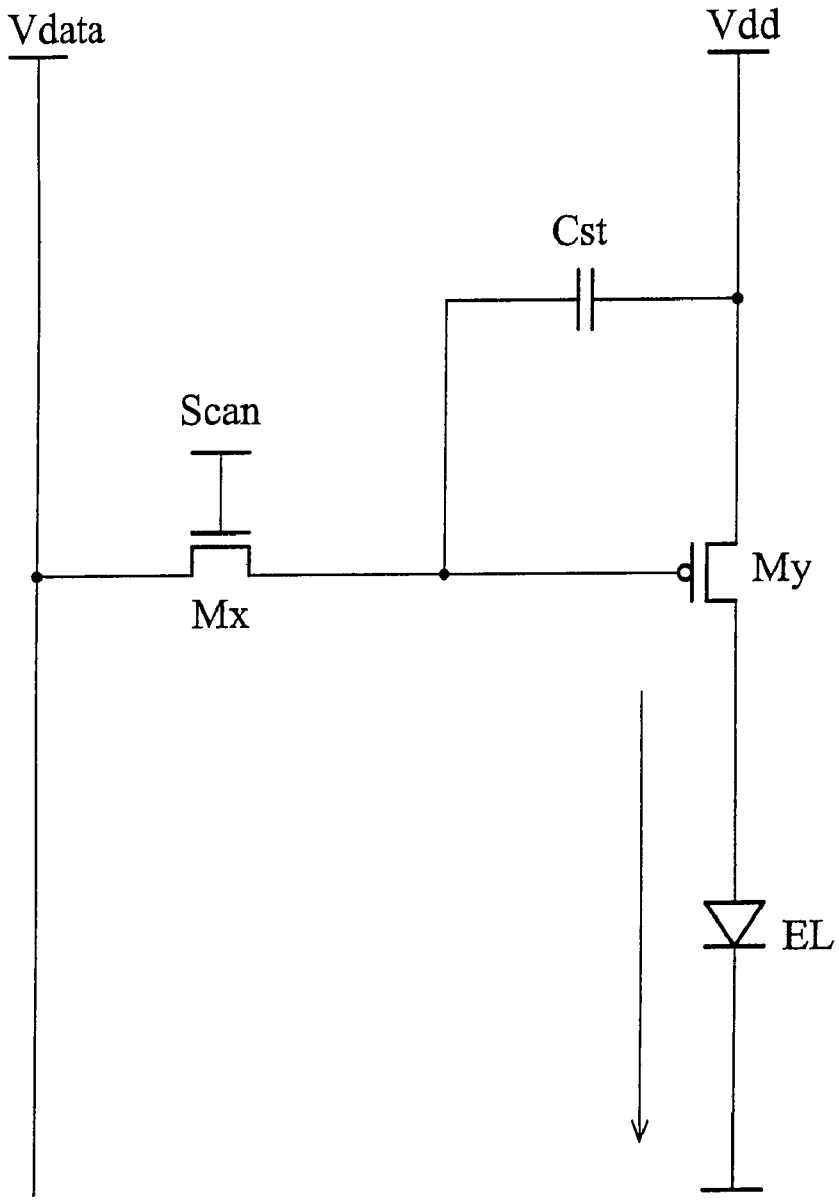
FIG. 1 ( RELATED ART )
FIG. 1 shows a conventional 2T1C (2 transistors and 1 capacitor) pixel driving circuit in an AMOLED display.
Figure 2:
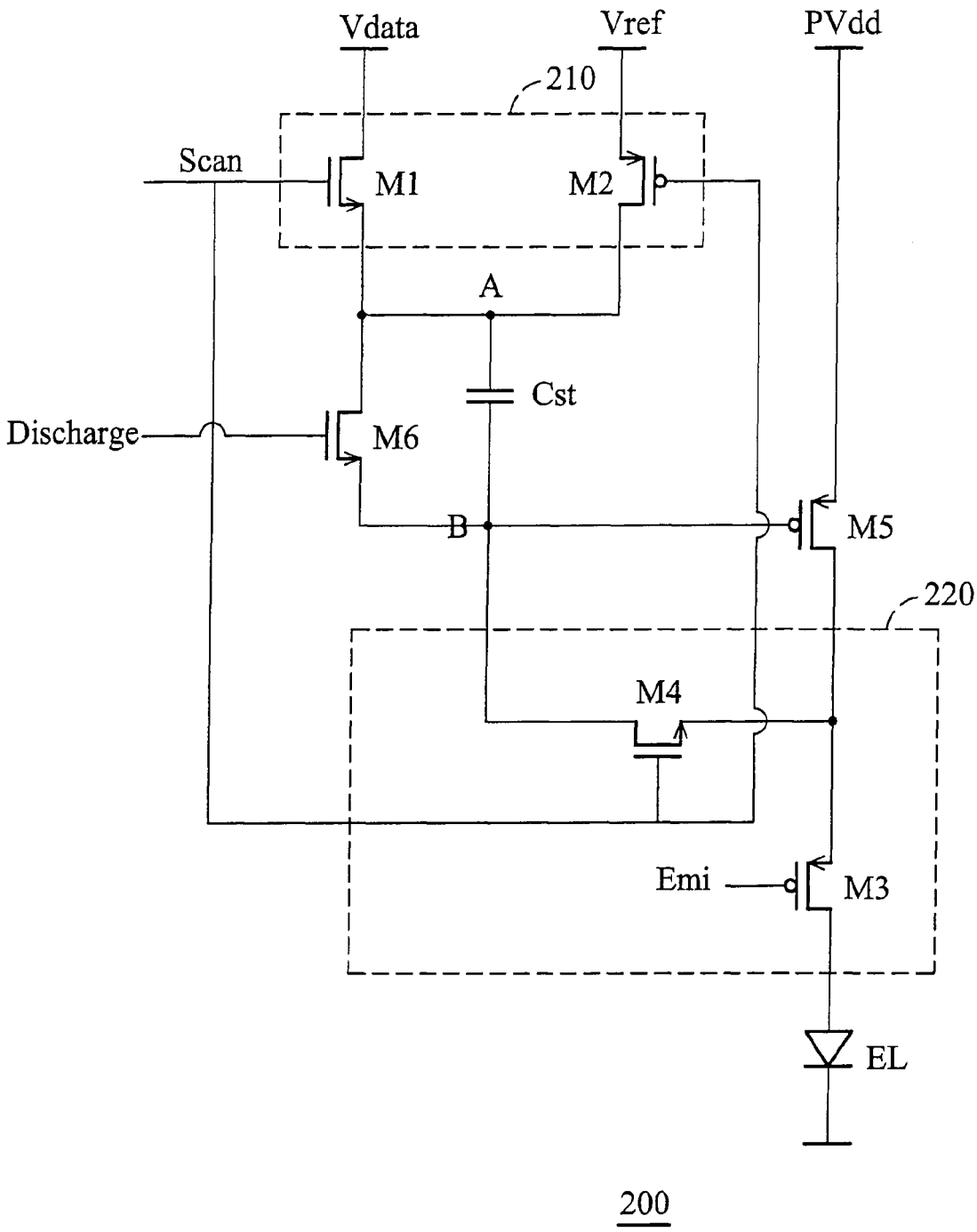
FIG. 2 shows a pixel driving circuit according to an embodiment of the invention.

FIG. 2 shows a pixel driving circuit according to an embodiment of the invention. Pixel driving circuit 200 compensates a threshold voltage and a power supply, such that the voltage of power supply PVdd is not limited by scan signal Scan. Pixel driving circuit 200 comprises storage capacitor Cst, transfer circuit 210, driving transistor M5, transistor M6 and switching circuit 220.

Transfer circuit 210 is coupled to first node A of storage capacitor Cst and transfers data signal Vdata or reference signal Vref to first node A of storage capacitor Cst. Reference signal Vref may be a fixed voltage signal. Driving transistor M5 may be a PMOS (positive-channel metal oxide semiconductor) transistor. A source terminal of transistor M5 is coupled to first voltage PVdd. A gate terminal of transistor M5 is coupled to second node B of storage capacitor Cst. More specifically, first voltage is power supply PVdd. Switching circuit 220 is coupled to a drain terminal of transistor M5. Switching circuit 220 directs transistor M5 to operate as a diode, such that transistor M5 becomes a diode-connected transistor once fourth transistor M4 is turned on.

Display device EL is coupled to switching circuit 220. Preferably, display device EL is an electroluminescent device. Additionally, a cathode of display device EL is coupled to a second voltage. More specifically, the second voltage is voltage VSS or ground voltage.

Transfer circuit 210 comprises first transistor M1 and second transistor M2, as shown in FIG. 2, wherein first transistor M1 and second transistor M2 are a NMOS (negative-channel metal oxide semiconductor) and a PMOS transistor respectively. A drain terminal of first transistor M1 receives data signal Vdata. A gate terminal and a source terminal of first transistor M1 are connected to first scan line Scan and first node A of storage capacitor Cst, respectively. A source terminal of second transistor M2 receives reference signal Vref. A gate terminal and a drain terminal of second transistor M2 are connected to scan line Scan and first node A of storage capacitor Cst, respectively. Preferably, transistors M1 and M2 are polysilicon thin film transistors, providing higher current driving capability.

When scan line Scan is pulled high, transfer circuit 210 transfers data signal Vdata to first node A of storage capacitor Cst. When scan line Scan is pulled low, transfer circuit 210 transfers reference signal Vref to first node A of storage capacitor Cst.

Switching circuit 220 comprises third transistor M3 and fourth transistor M4. As shown in FIG. 2, third transistor M3 is a PMOS transistor and fourth transistor M4 is a NMOS transistor. A drain terminal of third transistor M3 is connected to an anode of display device EL, while a gate terminal and a source terminal of third transistor M3 are connected to lighting signal Emi and driving transistor M5 respectively. Fourth transistor M4 comprises a source terminal coupled to driving transistor M5 and third transistor M3. A drain terminal of fourth transistor M4 is coupled to second node B of storage capacitor Cst, a source terminal of transistor M6 and a gate terminal of driving transistor M5. A gate terminal of fourth transistor M4 is connected to scan line Scan. Preferably, transistors M3 and M4 are polysilicon thin film transistors, providing higher current driving capability.

When scan line Scan is pulled high, fourth transistor M4 of switch circuit 220 directs driving transistor M5 to operate as a diode, becoming a diode-connected transistor once fourth transistor M4 is turned on.

A drain terminal of transistor M6 is coupled to first node A of storage capacitor Cst. A gate terminal of transistor M6 is coupled to discharge signal Discharge. A source terminal of transistor M6 is coupled to second node B of storage capacitor Cst, the drain terminal of transistor M4 and the gate terminal of driving transistor M5.

Figure 3:
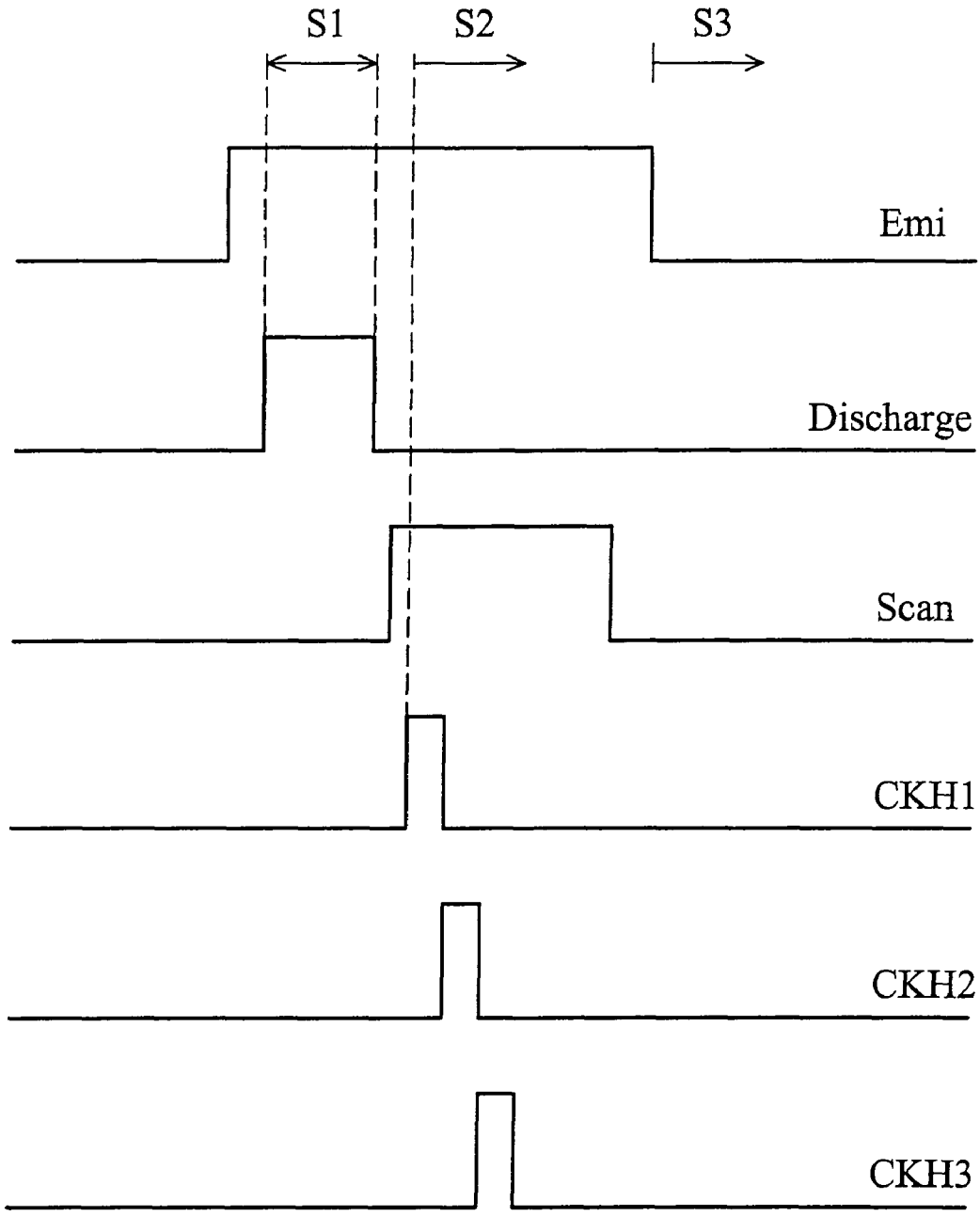
FIG. 3 is a timing diagram of signals of lighting signal Emi, discharge signal Discharge, scan lines Scan, and horizontal clock signals CKH1, CKH2 and CKH3 of pixel driving circuit.

FIG. 3 is a timing diagram of signals of lighting signal Emi, discharge signal Discharge, scan lines Scan, and horizontal clock signals CKH1, CKH2 and CKH3 of pixel driving circuit 200 shown in FIG. 2. From a previous emission mode of the pixel driving circuit, when discharge signal Discharge is pulled high and lighting signal Emi is kept high, pixel driving circuit 200 of FIG. 2 is in discharge mode S1. In discharge mode S1, transistor M6 is turned on, and a high-level reference signal Vref is input to first node A and second node B of storage capacitor Cst. The charge stored in storage capacitor Cst is thus discharged in this discharge mode. The discharge of storage capacitor Cst ensures normal operation in subsequent steps.

Following the discharge of storage capacitor Cst, scan signal Scan is pulled high, then pixel driving circuit 200 enters data load mode S2. When scan signal Scan is pulled high, first transistor M1 and fourth transistor M4 are turned on while second transistor M2 and transistor M6 are turned off. Since first transistor M1 and fourth transistor M4 are turned on, the voltage of first node A of storage capacitor Cst equals the voltage of data signal Vdata, where $V_{th}$ is the threshold voltage of driving transistor M5. Thus, the stored voltage across storage capacitor is Vdata−(PVdd−Vth).

When scan signal Scan is pulled low, data load mode S2 ends. When lighting signal Emi is pulled low, pixel driving circuit 200 enters emission mode S3. Since scan line signal Scan is low, second transistor M2 is turned on and the voltage of first node A of storage capacitor Cst is reference voltage Vref. Since the stored voltage across storage capacitor cannot be changed immediately, the voltage of second node B of storage capacitor Cst becomes Vref−[Vdata−(PVdd−Vth)]. Current through the display device is proportional to $(Vsg-Vth)^2$ and also proportional to $(Vdata-Vref)^2$. Thus, the current through display device EL is independent of threshold voltage $V_{th}$ of driving transistor M5 as well as power supply PVdd. The operation repeats continuously to control pixel emissions.

Figure 4:
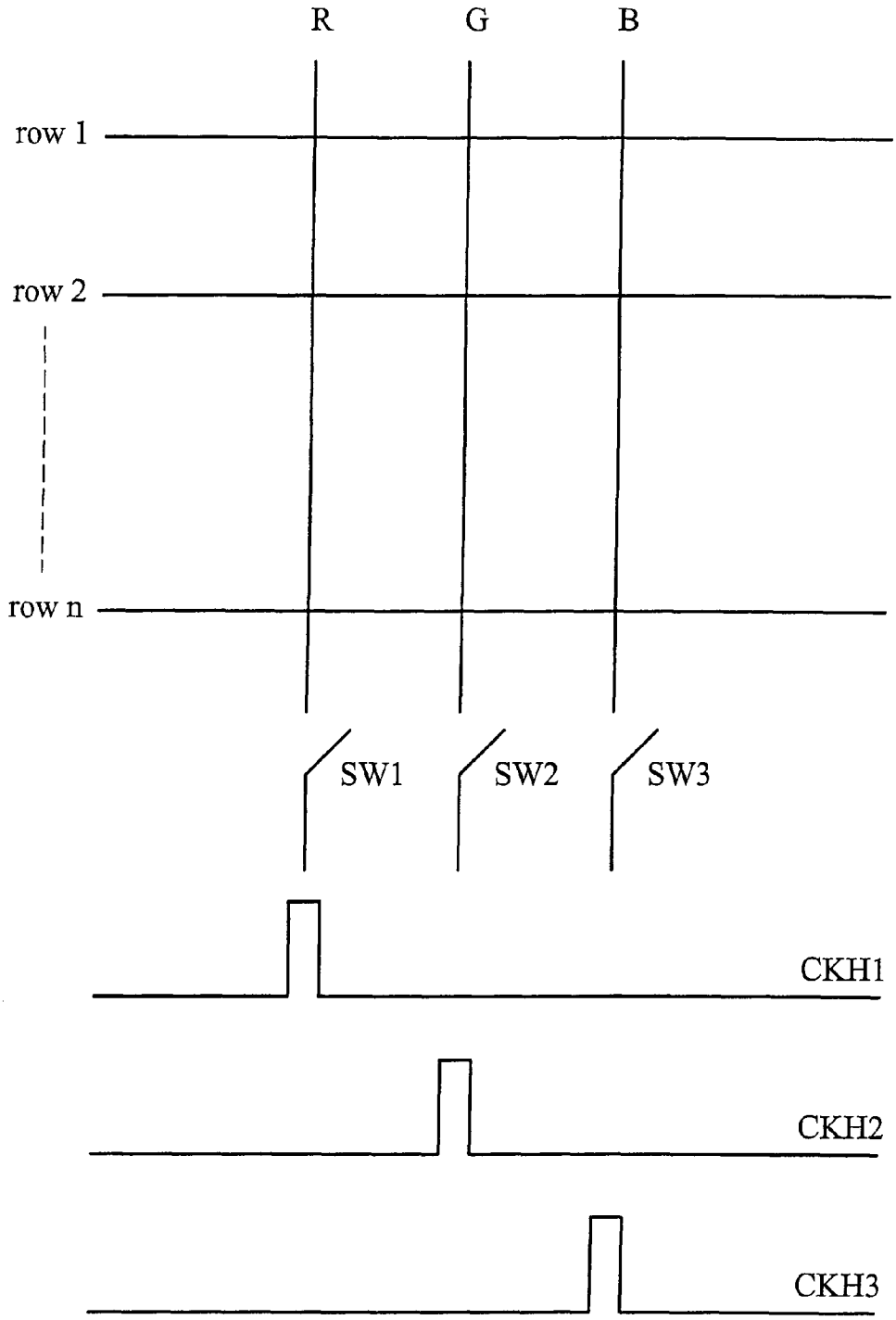
FIG. 4 shows an AMOLED display loading data into red R, green G and blue B signal lines respectively by using horizontal clock signals CKH1, CKH2 and CKH3.
Figure 5:
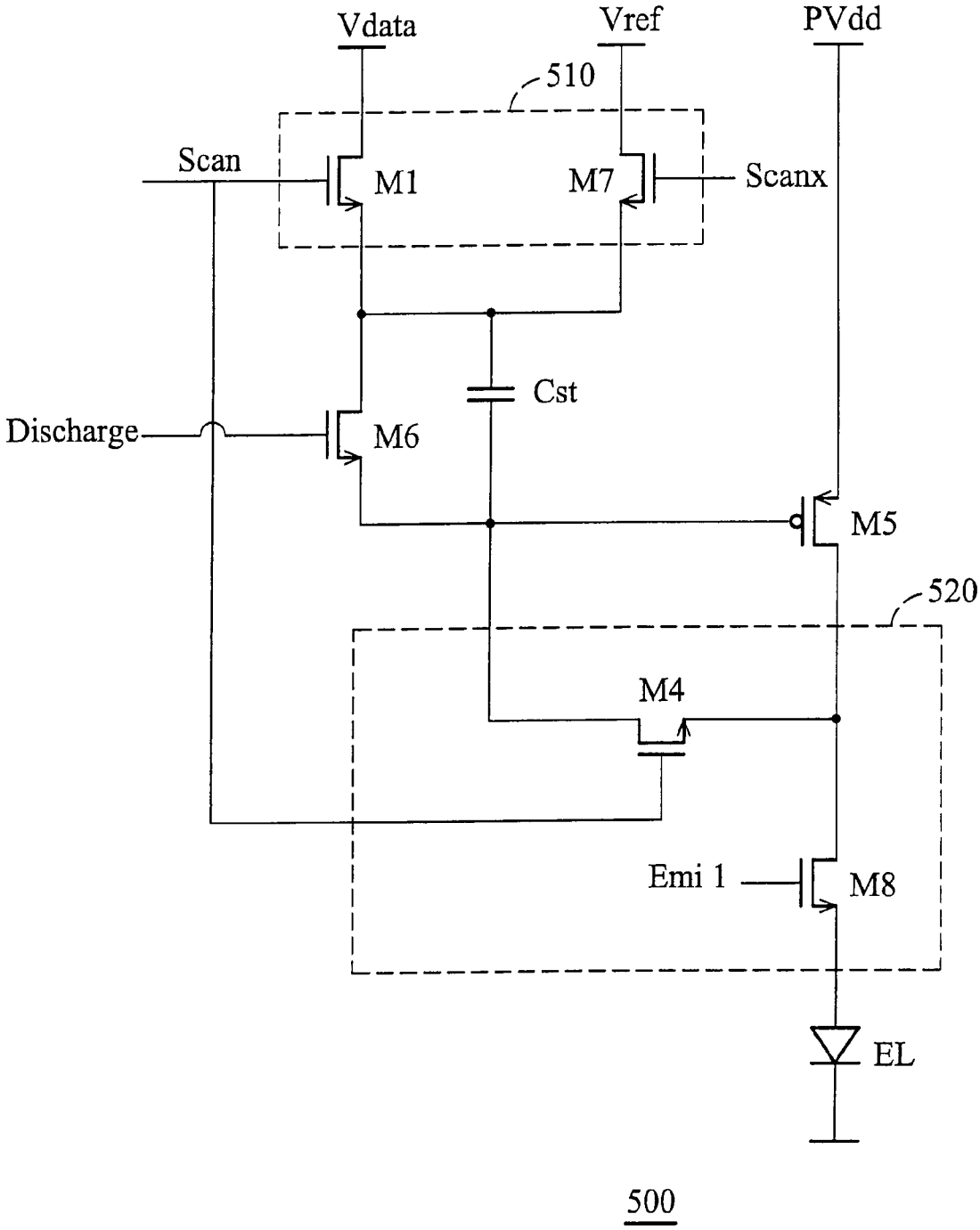
FIG. 5 shows a pixel driving circuit according to another embodiment of the invention.

FIG. 4 shows an AMOLED display loading data into red R, green G and blue B signal lines respectively by using horizontal clock signals CKH1, CKH2 and CKH3. When scan line signal Scan at row1, row2, . . . or rown is high, in data load mode S2, horizontal clock signals CKH1, CKH2 and CKH3 respectively turn on switches SW1, SW2 and SW3 sequentially and data is loaded in red R, green G and blue B signal lines sequentially, FIG. 5 shows pixel driving circuit 500 according to another embodiment of the invention. Pixel driving circuit 500 compensates a threshold voltage and a power supply, such that voltage of power supply PVdd is not limited by scan signal Scan. Pixel driving circuit 500 is similar to pixel driving circuit 200, except for transistors M7 and M8 of FIG. 5 being NMOS transistors while second transistor M2 and third transistor M3 of FIG. 2 are PMOS transistors. A gate terminal of transistor M7 of FIG. 5 is coupled to inverse scan line signal ScanX. The phase of inverse scan line signal ScanX is opposite to that of scan line signal Scan.

Figure 6:
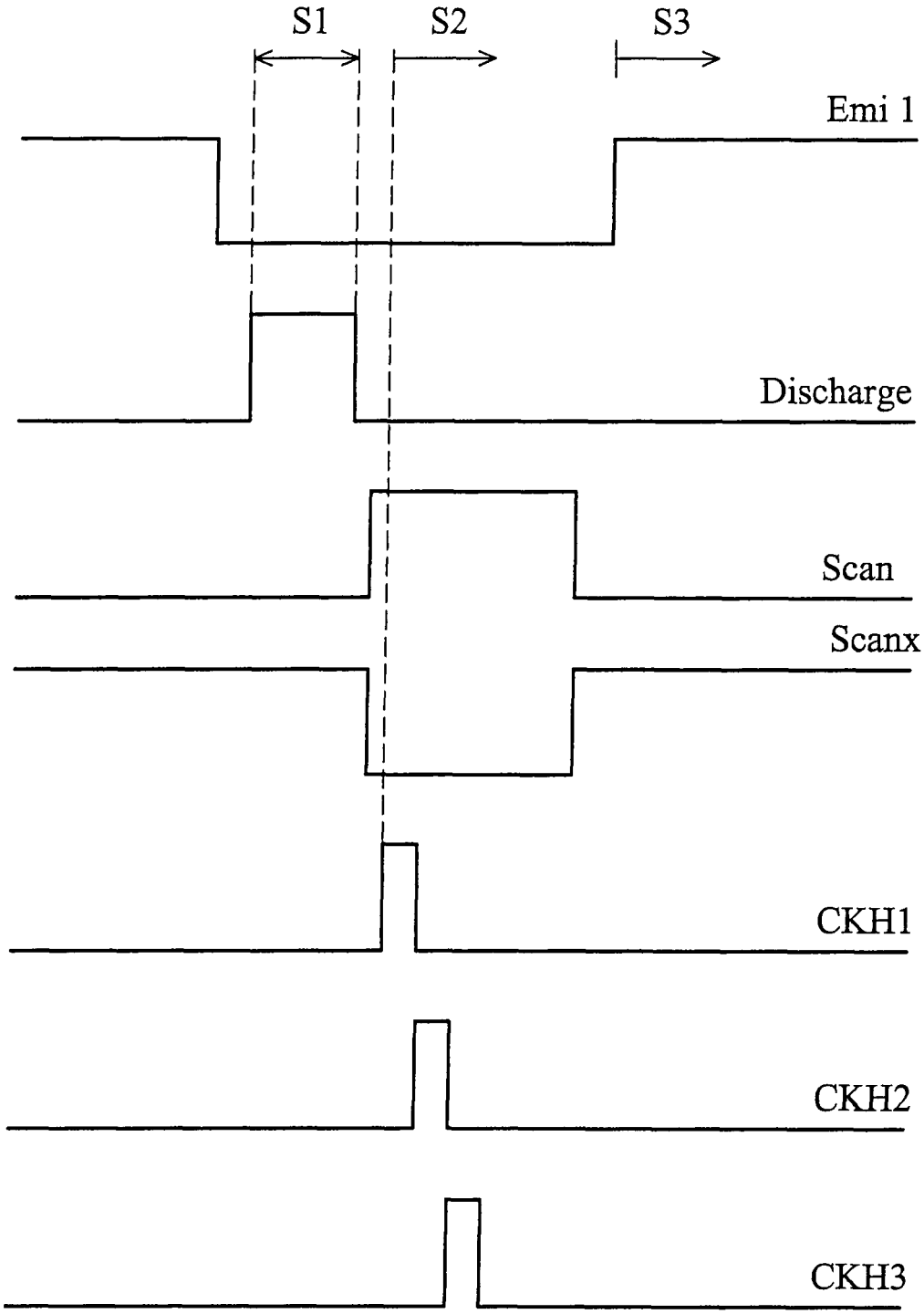
FIG. 6 is a timing diagram of signals of lighting signal Emi, discharge signal Discharge, scan line signal Scan, inverse scan line signal ScanX, and horizontal clock signals CKH1, CKH2 and CKH3 of pixel driving circuit.

FIG. 6 is a timing diagram of signals of lighting signal Emi, discharge signal Discharge, scan line signal Scan, inverse scan line signal ScanX, and horizontal clock signals CKH1, CKH2 and CKH3 of pixel driving circuit 500 shown in FIG. 5. From a previous emission mode of the pixel driving circuit, when discharge signal Discharge is pulled low and lighting signal Emi is kept low, pixel driving circuit 500 of FIG. 5 is operated in discharge mode S1. In discharge mode S1, transistor M6 is turned on, and a high-level reference signal Vref is input to first node A and second node B of storage capacitor Cst. The charge stored in storage capacitor Cst is thus discharged in this discharge mode. The discharge of storage capacitor Cst ensures normal operation in subsequent steps.

Figure 7:
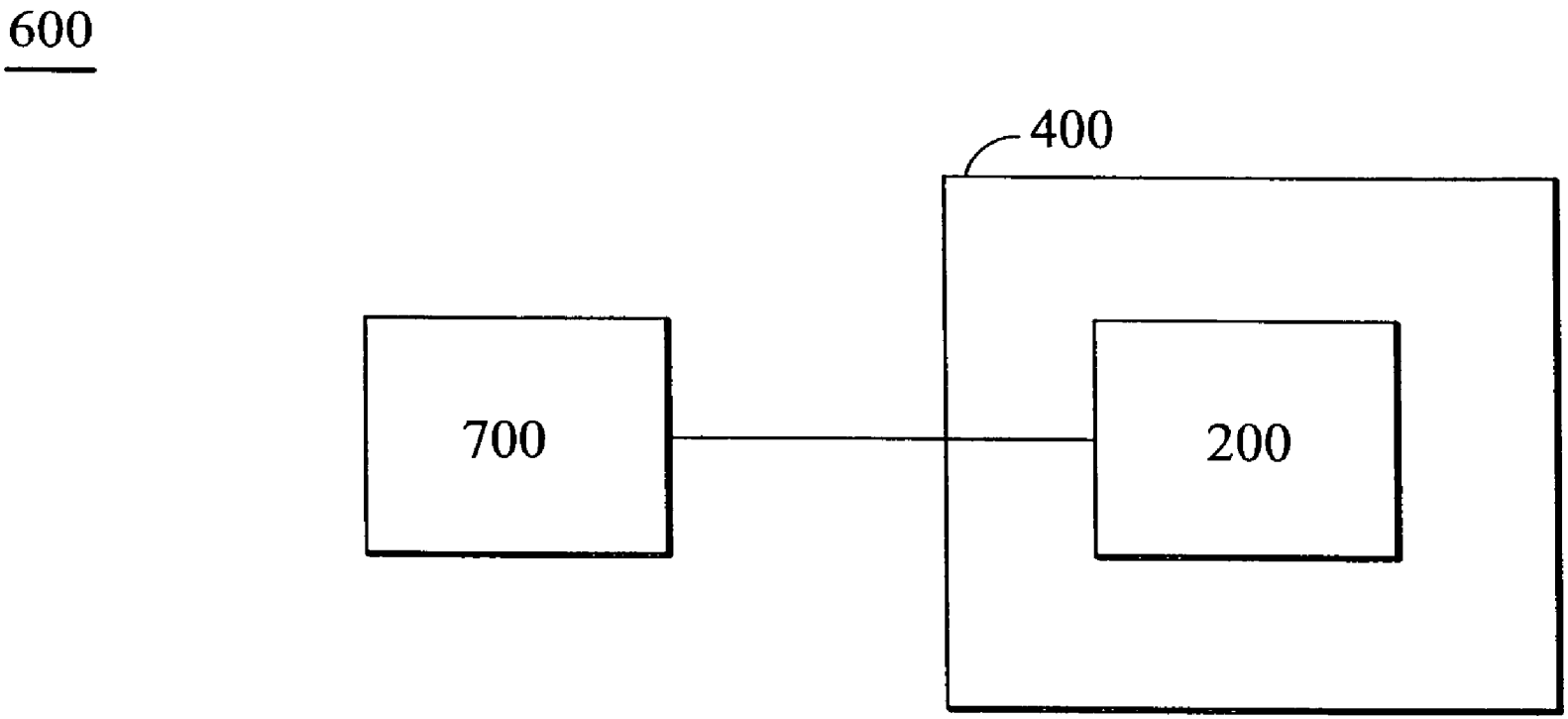
FIG. 7 schematically shows another embodiment of a system for displaying images.

FIG. 7 schematically shows another embodiment of a system for displaying images which, in this case, is implemented as display panel 400 or electronic device 600. As shown in FIG. 7, display panel 400 comprises a pixel driving circuit 200 of FIG. 2. Display panel 400 can form a portion of a variety of electronic devices (in this case, electronic device 600). Generally, electronic device 600 can comprise display panel 400 and power supply 700. Further, power supply 700 is operatively coupled to display panel 400 and provides power to display panel 400. Electronic device 600 can be a mobile phone, digital camera, PDA (personal data assistant), notebook computer, desktop computer, television, or portable DVD player, for example.

The operation of FIG. 5 is similar to that of FIG. 2. Thus, the electrical current through display device EL of FIG. 5 is proportional to $(Vsg-Vth)^2$ and is also proportional to $(Vdata-Vref)^2$. Thus, the current through display device EL of FIG. 5 is independent of threshold voltage $V_{th}$ of driving transistor M5 as well as power supply PVdd. The operation repeats continuously to control pixel emissions.

Pixel driving circuits 200 and 500 (FIGS. 2 and 5) of the embodiments of the present invention are independent of threshold voltage $V_{th}$ of driving transistor M5 as well as power supply PVdd. Power supply PVdd and scan line signal Scan are independent of each other. Thus, the voltage range of scan line signal Scan is not limited by the voltage range of power supply PVdd, and vice versa.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A system for displaying image, comprising:

a pixel driving circuit, comprising:

a storage capacitor having a first node and a second node;

a transistor having a gate coupled to a discharge signal, coupled between the first node and the second node, wherein the transistor is turned on by the discharge signal to discharge the storage capacitor during a first period;

a transfer circuit coupled to the first node of the storage capacitor, the transfer circuit transferring a data signal or a reference signal to the first node of the storage capacitor;

a driving element having a first terminal coupled to a first fixed potential, a second terminal coupled to the second node of the storage capacitor, and a third terminal outputting a driving current; and a switching circuit coupled between the driving element and a display element, directing the driving element to operate as a diode during a second period and allowing the driving current to be output to the display element during a third period.

2. The system as claimed in claim 1, wherein the transfer circuit comprises:

a first transistor having a fourth terminal coupled to a first scan line, a fifth terminal receiving the data signal, and a sixth terminal coupled to the first node of the storage capacitor; and a second transistor having a seventh terminal coupled to the first scan line, an eighth terminal receiving the reference signal, and a ninth terminal coupled to the first node of the storage capacitor.

3. The system as claimed in claim 2, wherein the first transistor and second transistor are a PMOS transistor and a NMOS transistor respectively.

4. The system as claimed in claim 1, wherein the transfer circuit comprises:

a first transistor having a fourth terminal coupled to a first scan line, a fifth terminal receiving the data signal, and a sixth terminal coupled to the first node of the storage capacitor; and a second transistor having a seventh terminal coupled to a second scan line, an eighth terminal receiving the reference signal, and a ninth terminal coupled to the first node of the storage capacitor.

5. The system as claimed in claim 4, wherein the first transistor and second transistor are NMOS transistors.

6. The system as claimed in claim 2, wherein the first transistor and second transistor are polysilicon thin film transistors.

7. The system as claimed in claim 4, wherein the first transistor and second transistor are polysilicon thin film transistors.

8. The system as claimed in claim 1, wherein the first period comes before the second period and third period.

9. The system as claimed in claim 1, wherein the switching circuit comprises:

a third transistor having a fourth terminal coupled to a lighting signal, a fifth terminal coupled to the display element, and a sixth terminal coupled to the driving element; and a fourth transistor having a seventh terminal coupled to the second node of the storage capacitor, an eighth terminal coupled to a first scan line, and a ninth terminal coupled to the driving element.

10. The system as claimed in claim 4, wherein the third transistor and fourth transistor are polysilicon thin film transistors.

11. The system as claimed in claim 1, wherein the first fixed potential is a power supply potential.

12. The system as claimed in claim 1, wherein the display device is an electroluminescent device.

13. The system as claimed in claim 1, further comprising a display panel, wherein the pixel driving circuit forms a portion of the display panel.

14. The system as claimed in claim 1, further comprising an electronic device, wherein the electronic device comprises:

the display panel; and a power supply coupled to and providing power to the display panel.

15. A method for driving a display element with a driving element and a storage capacitor, comprising:

discharging the storage capacitor through a transistor by applying a discharge signal thereto;

loading a data signal into a first terminal of the storage capacitor;

loading a gate voltage of the driving element into a second terminal of the storage capacitor;

loading a reference signal into the first terminal of the storage capacitor; and coupling the loaded data signal, the gate voltage and the reference signal into the driving element to provide a threshold-independent driving current to the display element.

16. The method as claimed in claim 15, wherein the gate voltage comprises a fixed voltage source voltage and a temporary voltage.

17. The method as claimed in claim 15, wherein loading begins at a discharge signal applied to a switch element for applying the reference signal to both terminals of the storage capacitor.

18. The method as claimed in claim 17, wherein discharge normalizes voltage at the first terminal and second terminal of the storage capacitor by turning on the transistor.

19. The method as claimed in claim 15, wherein the loaded data signal, the gate voltage and the reference signal are coupled to the driving element after the reference signal is applied on the storage capacitor.

20. The method as claimed in claim 16, wherein the driving element comprises a gate connected to the second terminal of the storage capacitor and a source connected to a fixed voltage source.

* * * * *